US006308676B1

(12) United States Patent
Coates

(10) Patent No.: US 6,308,676 B1
(45) Date of Patent: Oct. 30, 2001

(54) COOLING SYSTEM FOR ROTARY VALVE ENGINE

(76) Inventor: George J. Coates, Rte. 34 & Ridgewood Rd., Wall Township, NJ (US) 07719

( * ) Notice: Subject to any disclaimer, the term of this patent is extended or adjusted under 35 U.S.C. 154(b) by 0 days.

(21) Appl. No.: 09/657,788

(22) Filed: Sep. 8, 2000

(51) Int. Cl.[7] ..... F01L 7/00
(52) U.S. Cl. ..... 123/188.9; 123/190.2
(58) Field of Search ..... 123/188.9, 190.14, 123/190.2, 59.1, 80 R, 80 BA

*Primary Examiner*—Noah P. Kamen
(74) *Attorney, Agent, or Firm*—Clifford G. Frayne

(57) ABSTRACT

An improved cooling system for an internal combustion engine employing spherical rotary intake and exhaust valves which are fixedly mounted on a rotating shaft means, the improvement comprising the forming of the shaft means with a longitudinal throughbore, the throughbore in sealing contact with an inlet coupling and a outlet coupling for the circulation of coolant through the shaft during operation, the coolant in communication with the coolant reservoir for the engine such that it would undergo normal cooling in the radiator before being recirculated to the engine.

7 Claims, 6 Drawing Sheets

COOLING SYSTEM FOR ROTARY VALVE ENGINE

BACKGROUND OF THE INVENTION

1. Field of the Invention

The invention relates to an improved cooling system for an internal combustion engine and in particularly, an improved cooling system for an engine utilizing spherical rotary valves.

2. Description of the Prior Art

Applicant is the inventor of a novel spherical rotary valve assembly as evidenced by Applicant's prior U.S. Pat. Nos. 4,989,576; 4,953,527; 4,989,558; 4,944,261; 4,976,232; 5,109,814; and 5,361,739 which Applicant incorporates herein.

Typical cooling systems for internal combustion engines involve the circulation of water between a radiator which cools the water and the jacketed assembly of the engine and manifolds where the water is heated due to engine operation, the heated water then being circulated via hoses to the radiator and thence returned to the engine for further cooling. This is the manner of cooling on a typical poppet valve engine and it is the manner of cooling on Applicant's spherical rotary valve internal combustion engines.

It is known that the cooler the engine can run, and in particular, the cooler the exhaust valve can be maintained, the less nitrous oxides and other smog related mixtures are produced from the combustion of fuel in an internal combustion engine. In a typical poppet valve engine, there is no economical way to cool the valves in that they are operated by a cam shaft which repeatedly operates the valves in an up and down reciprocating motion extending them into the combustion chamber.

Applicant's spherical rotary valve engine employs an intake valve and an exhaust valve which do not require a cam shaft, but rather are mounted on a shaft and rotate in their respective position above the inlet port and outlet port of a cylinder of an internal combustion engine. The spherical rotary intake valves and spherical rotary exhaust valves of Applicant's invention are mounted on a shaft upon which they are keyed such that the shaft and the valves rotate in unison. Since the spherical rotary intake valve and spherical rotary exhaust valve do not reciprocate into the cylinder, they already operate at a cooler temperature than a normal poppet valve. However since they are mounted on a cylindrical shaft and are in intimate contact therewith, there is a further opportunity to reduce the temperature of the spherical rotary valves during operation by providing coolant through a central bore in the shaft during operation which coolant would circulate with the coolant already provided for and circulating in the jacketed assembly of the engine and manifold and the radiator.

OBJECTS OF THE INVENTION

An object of the present invention is to provide for an improved novel cooling system for an internal combustion engine employing spherical rotary valve assemblies.

A further object of the present invention is to provide for an improved novel cooling system which would further reduce the temperatures of a spherical rotary intake valve and spherical rotary exhaust valve during operation.

A still further object of the present invention is to provide for an improved novel coolant assembly which would reduce the operating temperature of the spherical rotary intake valve and spherical rotary exhaust valve and thereby reduce the emissions from an internal combustion engine employing such spherical rotary valve assembly technology.

A still further object of the present invention is to provide for a novel coolant assembly for delivery and removal of water from a mounting shaft of a spherical rotary valve engine which insures against leakage of coolant into the engine head.

SUMMARY OF THE INVENTION

An improved cooling system for an internal combustion engine employing spherical rotary intake valves and spherical rotary exhaust valves fixedly mounted on a rotating shaft means whereby the rotating shaft means is provided with a longitudinal throughbore, the throughbore in sealing contact with an inlet coupling and an outlet coupling for the circulation of coolant through the shaft during operation, the coolant in communication with the coolant reservoir for the engine such that it would undergo normal cooling in the radiator before being recirculated to the engine, the coolant passing through the throughbore of the rotating shaft providing further coolant to the spherical rotary intake valve and spherical rotary exhaust valve such as to reduce operating temperatures and resultant emissions.

BRIEF DESCRIPTION OF THE DRAWINGS

These and other objects of the present invention will become evident, particularly when taken in light of the following illustrations wherein.

DETAILED DESCRIPTION OF THE DRAWINGS

The main difference between a standard poppet valve engine and an engine using spherical rotary valves is that the cam shaft, rocker arms, valves stems and poppet valves of a conventional engine are not required. The shaft upon which the spherical rotary valves are mounted and the valves themselves in essence form the cam shaft and valve assembly as one. The valves are mounted on the shaft and keyed into position to effectuate the timing with respect to each individual cylinder's intake, compression, power and exhaust stroke. Applicant will not go into detail with respect to the design and operation of the spherical rotary valve engine, but rather incorporates the aforementioned patents issued to Applicant in this application as if set forth at length and in detail.

Figure 1:
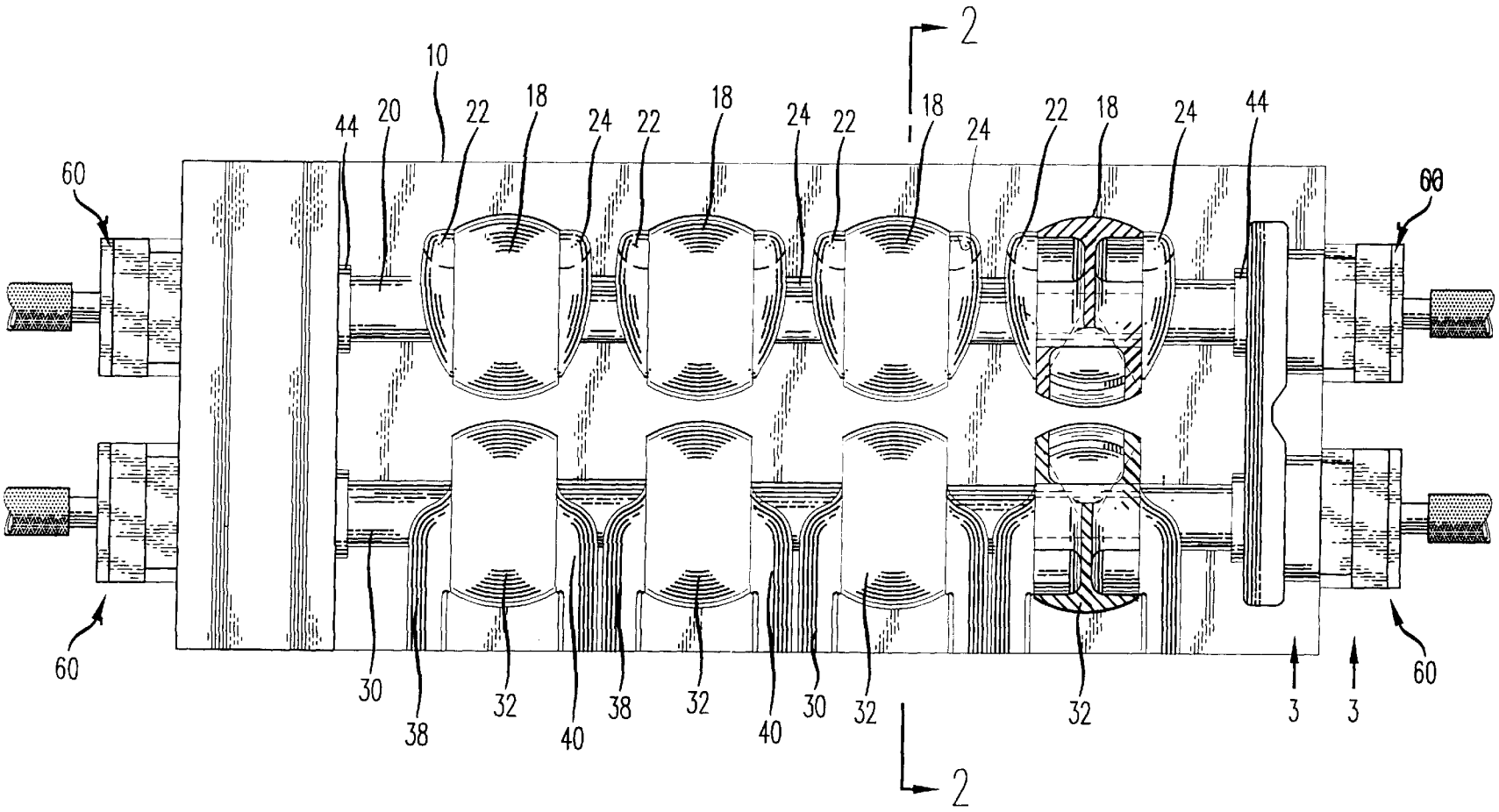
FIG. 1 is a top view of a four cylinder split head assembly with the top half removed illustrating the positioning of the spherical rotary intake valve and the spherical rotary exhaust valve.
Figure 2:
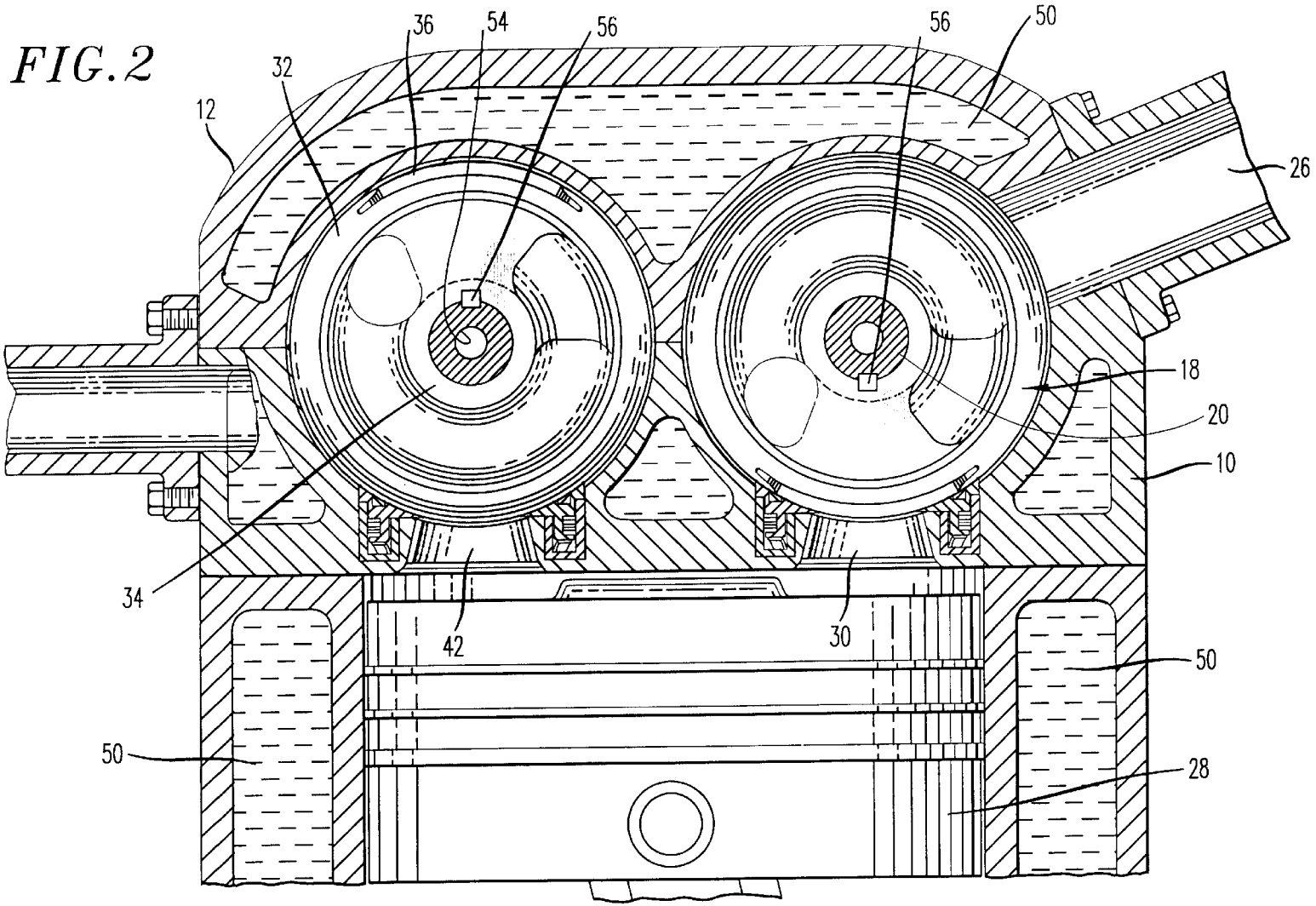
FIG. 2 is a cross sectional view along plane 2—2 of FIG. 1.

FIG. 1 is a top view of a split head four cylinder assembly with the top half removed, utilizing spherical rotary intake valves and spherical rotary exhaust valves and FIG. 2 is a cutaway end view along plane 2–2 of FIG. 1, including the top half of the split head. The lower portion of the head 10 would be mated with an upper portion 12 (FIG. 2) so as to form cavities within which the intake and exhaust spherical valves would sit and rotate. The spherical rotary intake valves 18 are mounted and keyed to intake shaft 20 with each spherical rotary intake valve 18 in communication with side cavities 22 and 24 which are in communication with the intake manifold 26 and permit the fuel air mixture to flow to the valve and into the cylinder 28 when the valve is aligned with the inlet port 30. The spherical rotary exhaust valves 32 are similarly mounted and keyed onto a second shaft, exhaust shaft 34 for rotation within their respective cavity 36. Each spherical rotary exhaust valve 32 is in communication with an exhaust chamber 38 and 40 on opposing sides of the spherical rotary exhaust valve 32 for the evacuation of spent gases from the cylinder 28 when the exhaust valve is in alignment with the exhaust port 42. Intake shaft 20 and exhaust shaft 34 rotate on the bearing surfaces 44. FIG. 1 illustrates an engine in which the intake valves and exhaust valves are mounted on separate shafts. In certain designs the intake and exhaust valves may be mated on the same shaft. The coolant assembly disclosed herein would have application to such a design. The coupling members 60 are shown in FIG. 1 on the exterior of the head 10 in alignment with shafts 20 and 34.

FIG. 2 is a cutaway view along plane 2—2 of FIG. 1 which illustrates the relationship between the spherical rotary intake valve and the spherical rotary exhaust valve, the cylinder head, piston and inlet and outlet ports. FIG. 2 also illustrates the split head assembly with the top half 12 of the split head in position. In this configuration it can be seen that the engine has a plurality of reservoirs 50 for the circulation of coolant to cool the engine. Applicant's improvement to this engine assembly is to utilize the intake shaft 20 and an exhaust shaft 32 to circulate coolant there being a throughbore 52 and 54 respectively therethrough for the further circulation of coolant. FIG. 2 illustrates that the spherical rotary intake valve 18 and the spherical rotary exhaust valve 32 are secured to intake shaft 20 and exhaust shaft 34 in an intimate manner and are positioned by a key 56.

Figure 3:
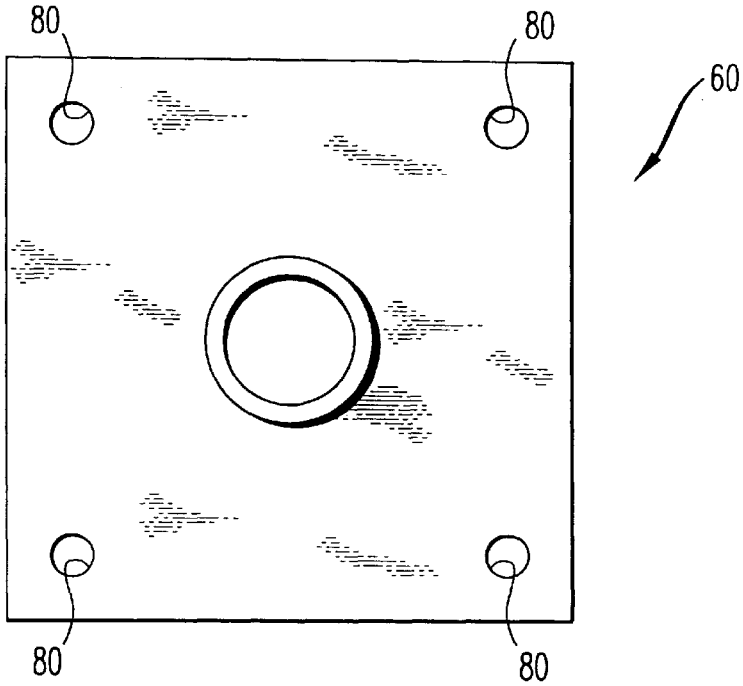
FIG. 3 is a front view of the coupling member for communicating coolant to the spherical rotary valve mounting shaft.
Figure 4:
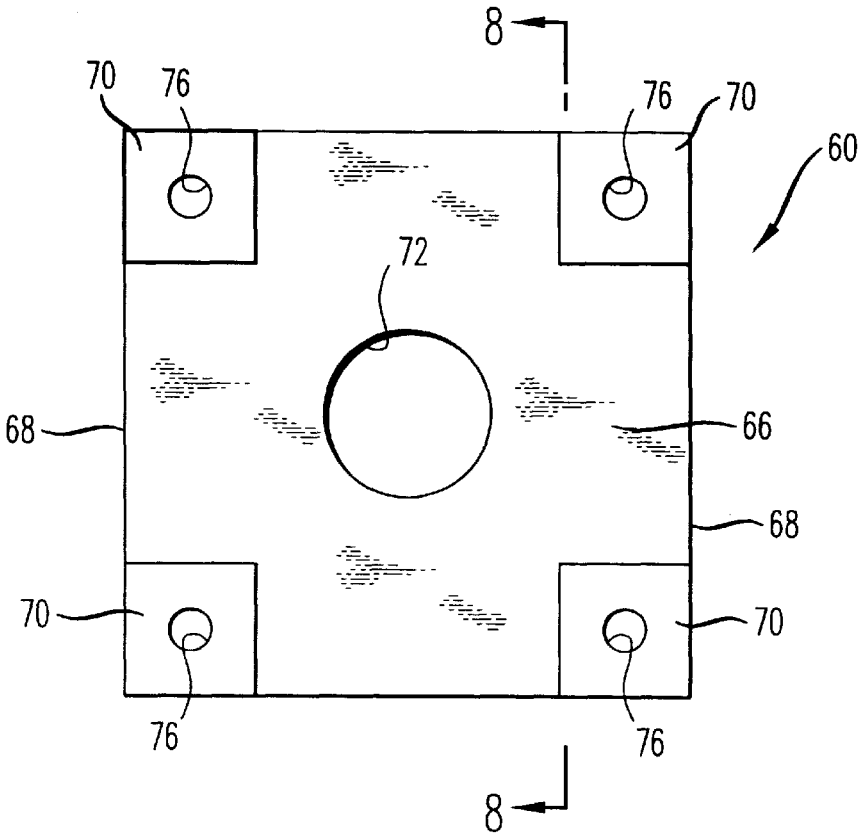
FIG. 4 is a back view of the coupling member.
Figure 5:
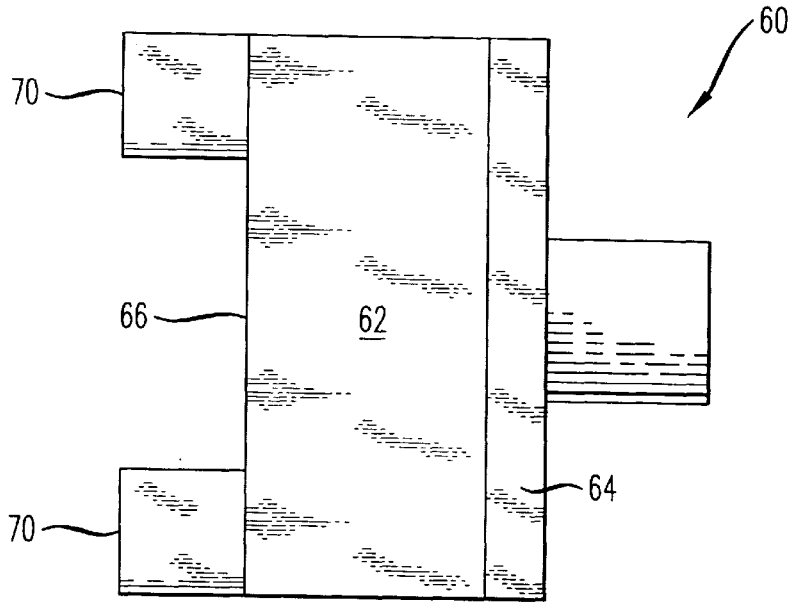
FIG. 5 is a side view of the coupling member.
Figure 6:
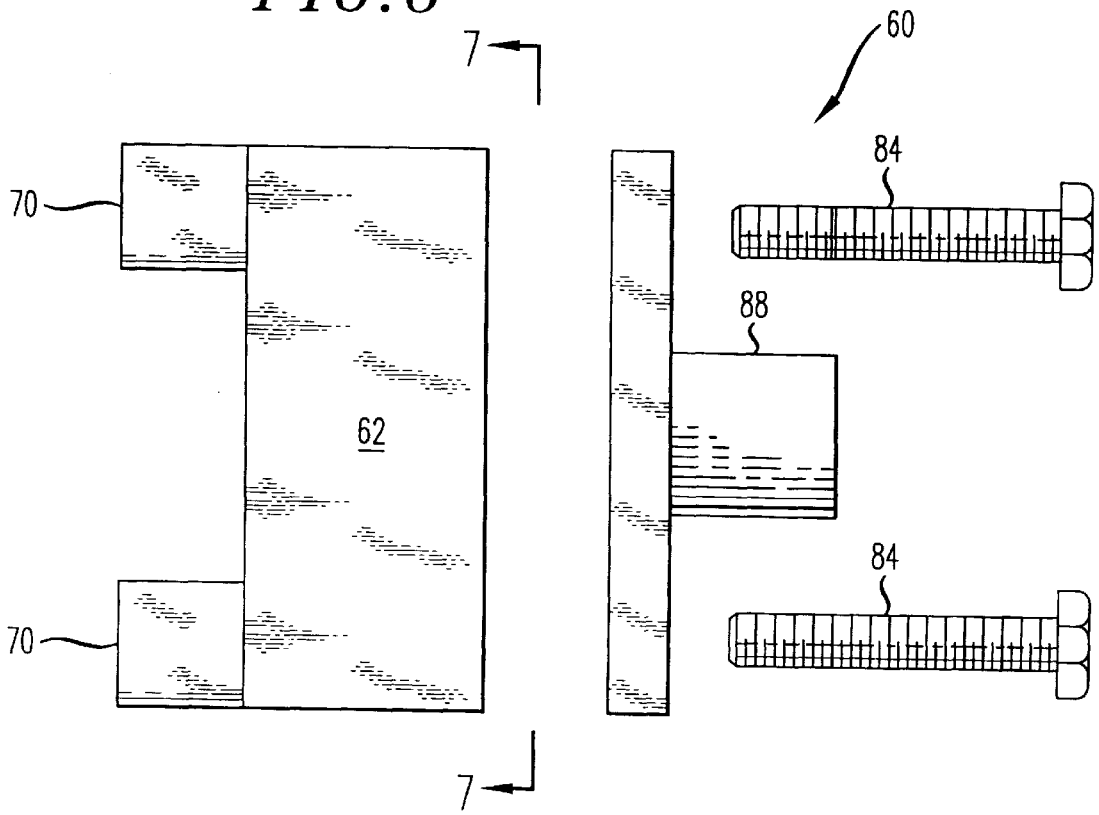
FIG. 6 is a side exploded view of the coupling member.
Figure 7:
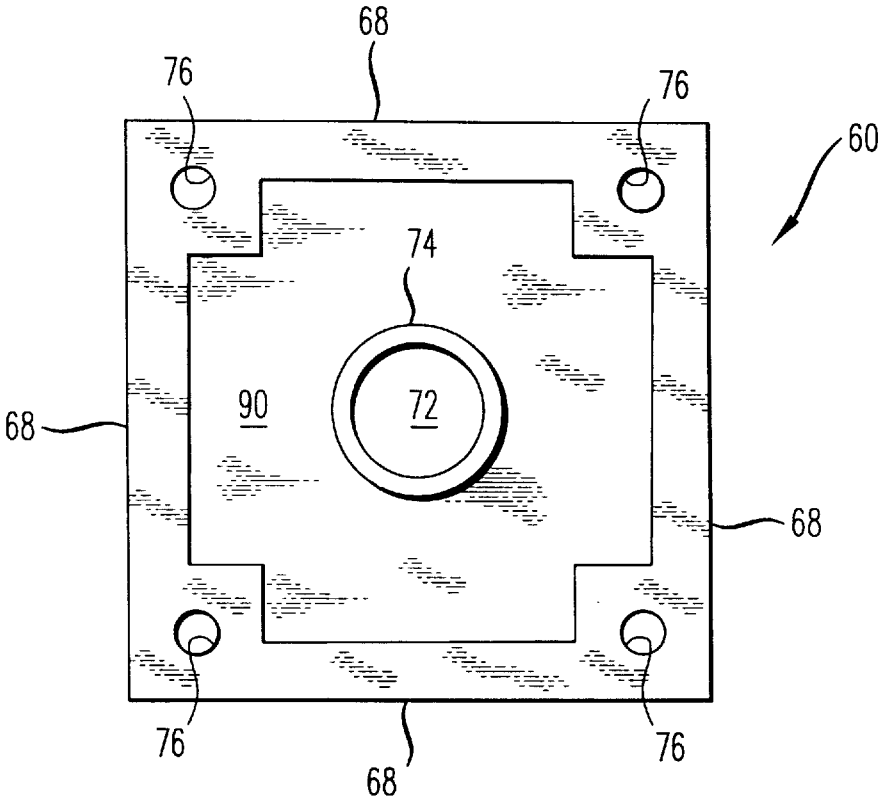
FIG. 7 is a front view of the interior of the coupling.

FIG. 3 is a front view of the coupling member, FIG. 4 is a rear view of the coupling member, FIG. 5 is a side view of the coupling member, FIG. 6 is a exploded side view of the coupling member, and FIG. 7 is a front view of the coupling member along plane 7—7 of FIG. 6. The coupling member 60 is generally of two piece construction. It comprises a housing member 62 and a closure member 64. Housing member 62 is defined by a rear wall 66 and a peripheral side wall 68 which in the instant embodiment is shown to be quadrilateral in shape, however, coupling member 60 could be formed of any suitable geometric shape. The rear wall 66 of housing member 62 has a plurality of legs 70 extending outwardly therefrom. In the instant embodiment, legs 70 are four in number and are positioned at the corners of rear wall 66. The purpose of legs 70 will be discussed more thoroughly hereafter. Also formed in rear wall 66, is an aperture 72 which has an annular shoulder 74 formed internally about its circumference. Positioned proximate the corners of housing member 60 are throughbores 76.

Closure member 64 is quadrilateral in shape and its periphery conforms to the peripheral side wall 68 of housing member 62. Closure member 64 also has apertures 80 positioned proximate its corners and alignable with the throughbores 76 in housing member 62 to accommodate a securing means 84. Securing means 84 effectively secure closure member 64 to housing member 62 and the assembled coupling member 60 to the engine head. Closure member 64 has formed on its outward face 86 a nozzle or spout member 88 for the receipt of a hose in communication with the coolant system of the engine. When closure member 64 is secured to housing member 62, there is defined a chamber 90 which is in communication with the nozzle or spout 88 and aperture 72 in the rear wall 66 or housing member 62.

Figure 8:
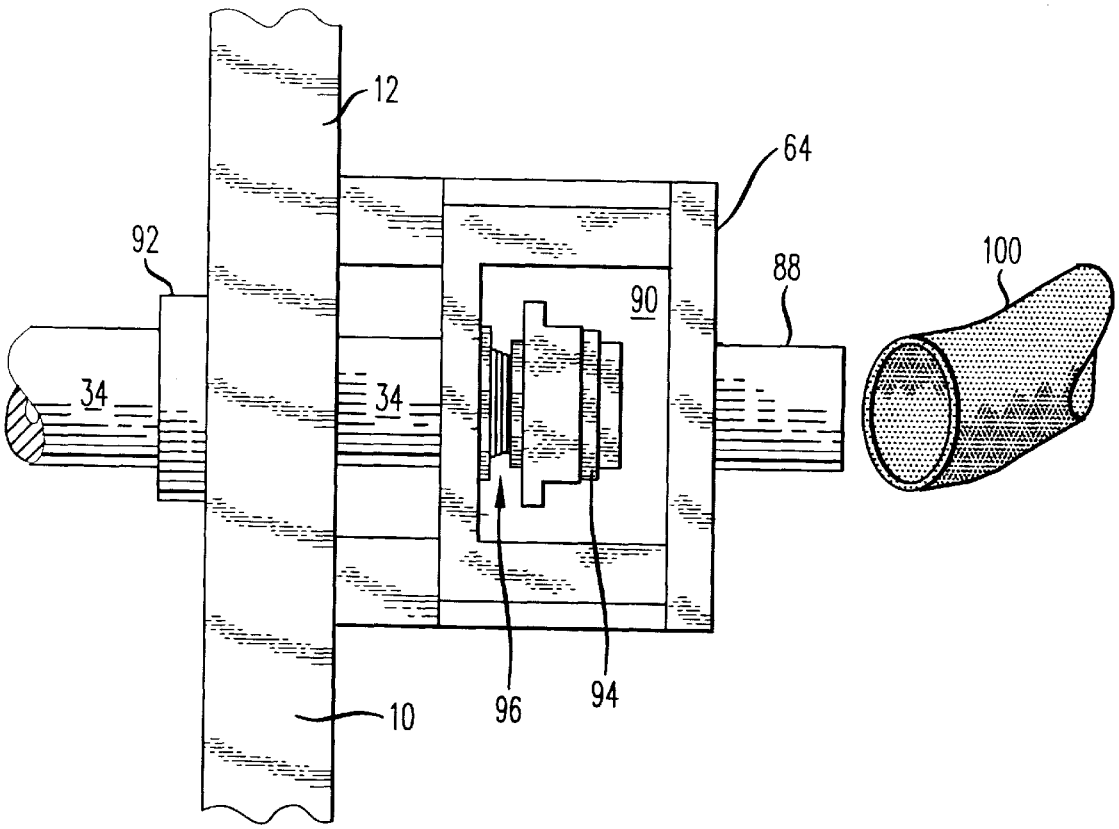
FIG. 8 is a side cutaway view of the coupling member along plane 8—8 of FIG. 4 illustrating the coupling member secured to the head.

FIG. 8 is a cutaway view along plane 8—8 of FIG. 4 illustrating the interior of coupling member 60 when it is secured to the engine block and affixed to shaft 20 or 34.

The same type coupling would be used on both shafts, both for the introduction and for the removal of the coolant from the respective shaft. Therefore it will be described in only one sequence, that being with the introductory coupling for coolant into the exhaust shaft 34.

As can be seen, exhaust shaft 34 is extended in length so as to extend outwardly from the split head block 10 and 12. It would be mounted on suitable bearing surfaces with seals 92. Its extension would terminate within chamber 90 of coupling member 60 which would be mounted to the exterior of the split head 10 and 12 by fastening means 84. The coupling 60 would define a chamber 90 within which the exhaust shaft 34 would terminate. The end of the exhaust shaft 34 would be threaded or adapted to accept a locking nut or snap lock 94 to secure a spring loaded seal 96 against a gasket 98 in the rear wall 68 of coupling 60. The front wall 64 of coupling 60 would have a tubular member 88 formed thereon and preferably in alignment with the throughbore of the exhaust shaft 34. To this tubular member, a suitable connector conduit 100 such as a hose would be connected such that coolant from the coolant reservoir could be directed into chamber 90 and at steady state, would travel down the throughbore 54 of exhaust shaft 34 and would exit the throughbore of exhaust shaft 34 into an identical coupling 60 where the coolant would then exit the coupling via tubular member 88 and be recirculated within the coolant reservoir by a similar connector conduit 100 for cooling before being recirculated to the engine either to the engine block or to the exhaust shaft 34 or intake shaft 20.

Figure 9:
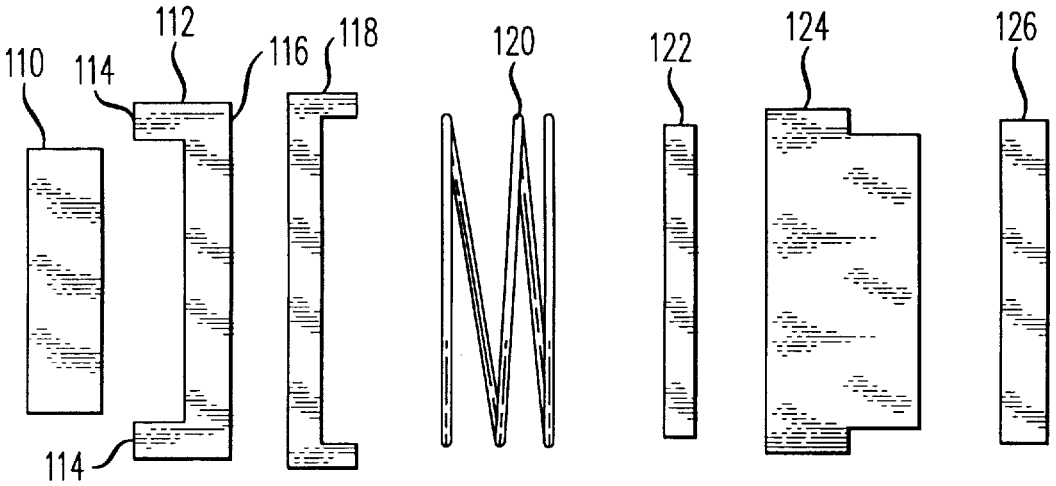
FIG. 9 is an exploded view of the sealing means employed within the coupling member on the spherical rotary valve mounting shaft.

FIG. 9 is an exploded view of the sealing means utilized within the coupling member 60. Aperture 72 in rear wall 66 of coupling member 60 is formed with an annular recessed shoulder 74. A ceramic gasket 110 is secured within a collar member 112 and press fit into aperture 72 such that the annular surface 114 of collar 112 abuts the annular shoulder 74 and the annular front surface 116 of collar 112 would be flush with the inner surface of the rear wall 66. The shaft 34 would pass through ceramic gasket 110 and collar 112 into the chamber 90 of coupling member 60. A press ring 118 would then be slipped over the shaft 34 and positioned in intimate contact with surface 116 of collar 112. Next, a coil spring 120 would be slipped over shaft 34. Finally, a second gasket member 122 and cap member 124 would be positioned on shaft 34. Cap member 124, second gasket member 122 would then be tightened against coil spring 120 by means of a locking nut or snap nut 126 to assert pressure against the collar 112 and ceramic gasket 110 to effectuate a seal.

Shaft 34 is sealed within engine head 10 and 12 by means of a variety of seals contained therein in order to prevent the leakage of any lubricant and also to prevent the ingress of any water. The sealing mechanism illustrated in FIG. 9 prevents water from chamber 90 from leaking towards any internal seals in the engine head. Nevertheless as a further feature, legs 70 on rear wall 66 dispose the coupling mechanism away from the engine block. Therefore in the event that the coupling member seal failed, water would fall downwardly under the influence of gravity and would not be in a position to intimately contact any of the head seals associated with the shaft 34. Thus the likelihood of any unwanted seepage along shaft 34 into the engine head is eliminated.

While it will be recognized by those of ordinary skill in the art that many changes and modifications can be made with respect to the disclosure herein, it is manifestly intended that the invention be limited only by the scope of the claims and the equivalence thereof.

What is claimed is:

1. An improved coolant system for an internal combustion engine of the type utilizing a spherical rotary valve assembly wherein said spherical rotary valve assembly comprises a removable two piece cylinder head securable to the internal combustion engine, said two piece removable cylinder head comprising an upper and lower cylinder head section such that when secured to said internal combustion engine define cavities, said cavities for receipt of a plurality of aligned spherical rotary intake valves and a plurality of aligned spherical rotary exhaust valves in communication with a cylinder; said spherical rotary intake and exhaust valves mounted on a rotating shaft means journaled on bearing surfaces within said two piece cylinder head and aligned with said cylinders of said internal combustion engine said improvement comprising:

forming said shaft means with a longitudinal throughbore for the passage of coolant therethrough and extending said shaft means exteriorly of said two piece cylinder head at both ends and terminating each end of said shaft means in a coupling member secured to the exterior of said two piece cylinder head, said coupling member defining a reservoir chamber, said reservoir chamber in communication with a conduit in communication with a coolant system to permit the introduction of coolant to said reservoir chamber and into said throughbore of said shaft means at a first end of said shaft means and a conduit in communication with said reservoir chamber of a coupling member at said second end of said shaft means for directing coolant away from said shaft means to said coolant system; said shaft means mounted on a bearing means and having a first sealing means proximate said exterior wall of said two piece cylinder head, said shaft means having second sealing means positioned within said reservoir chamber of said coupling member.

2. The improved coolant system for an internal combustion engine in accordance with claim 1 wherein said coupling member secured to the said exterior of said two piece cylinder head is secured in spaced-apart relationship to said cylinder head.

3. The improved coolant system for an internal combustion engine in accordance with claim 1 wherein said end of said shaft means in said reservoir chamber of said coupling member is sealed to said coupling member by means of a ceramic gasket and spring seal mechanism.

4. The improved coolant system for an internal combustion engine in accordance with claim 1 wherein said coupling member is of two piece construction having a housing member and a closure member secured by a fastening means which simultaneously secure said coupling member to said cylinder head.

5. A coupling member for providing coolant to a rotating shaft having a throughbore and supporting spherical rotary valves in internal combustion engine, said coupling member comprising:

a housing member defined by a rear wall having a generally perpendicular, peripheral side wall, said rear wall having an aperture therethrough and a plurality of protruding legs extending outwardly therefrom;

a closure member having a peripheral edge coextensive with said peripheral side wall of said housing member said closure member having an aperture therethrough said aperture having a tubular nozzle member extending outwardly therefrom, for communicating with a cooling system, said housing member and said closure member having a plurality of alignable apertures therethrough for receipt of a securing means to secure said closure member to said housing member in sealing engagement and to secure said housing member and said closure member to a cylinder head of an internal combustion engine in sealing engagement with an end of a valve supporting shaft means extending outwardly from said cylinder head, said shaft means having a throughbore for the passage of a coolant, said end of said shaft means in sealing engagement with said coupling member.

6. The coupling member in accordance with claim 5 wherein said sealing engagement of said shaft means with said coupling member comprises a ceramic gasket and spring seal secured about said shaft means within said coupling member.

7. The coupling member in accordance with claim 5 wherein one each of said coupling members is secured to opposing ends of said shaft means external said cylinder head, one each of said coupling members for the introduction of a coolant into said throughbore of said shaft means and one each of said coupling members for the evacuation of said coolant from said throughbore of said shaft means to said cooling system.

* * * * *